US006161730A

United States Patent [19]

Heusser et al.

[11] Patent Number: 6,161,730

[45] Date of Patent: Dec. 19, 2000

[54] APPARATUS FOR CARRYING OUT A MIXING DISPENSING OF A PLURALITY OF FLOWABLE COMPONENTS

[75] Inventors: Rolf Heusser; Markus Fleischli, both of Winterthur; Thomas Grütter, Oberdürnten; Reto Maeder, Zürich; Arno Signer, Wiesendangen, all of Switzerland

[73] Assignee: Sulzer Chemtech AG, Winterthur, Switzerland

[21] Appl. No.: 09/396,020

[22] Filed: Sep. 15, 1999

[30] Foreign Application Priority Data

Sep. 18, 1998 [EP] European Pat. Off. ..... 98810934

[51] Int. Cl.[7] ..... B67D 5/52

[52] U.S. Cl. ..... 222/137; 222/145.6

[58] Field of Search ..... 222/134, 135, 222/137, 145.6, 459, 567

[56] References Cited

U.S. PATENT DOCUMENTS

| | | | |
|---|---|---|---|
| 4,771,919 | 9/1988 | Ernst | 222/134 |
| 5,080,262 | 1/1992 | Herold et al. | 222/135 |
| 5,413,253 | 5/1995 | Simmen . | |

FOREIGN PATENT DOCUMENTS

| | | |
|---|---|---|
| 0319135A2 | 6/1989 | European Pat. Off. . |
| 0723807A2 | 7/1996 | European Pat. Off. . |
| 0815929A1 | 1/1998 | European Pat. Off. . |
| 4138351A1 | 5/1993 | Germany . |
| 9405922 | 8/1994 | Germany . |

*Primary Examiner*—Kevin Shaver
*Assistant Examiner*—Thach H Bui
*Attorney, Agent, or Firm*—Townsend and Townsend and Crew LLP

[57] ABSTRACT

The apparatus for carrying out a mixing dispensing of a plurality of flowable components from a multiple chambered vessel (2) comprises the following parts:

a housing (1) which can be placed onto the vessel and has an outlet opening (12), a transition part (11) which can be coupled on to the vessel and a tubular part (10) between the transition part and the outlet opening;

a static mixer (4) consisting of a structure which can be pushed into the tubular part;

a transition piece (3) which is arranged in the transition part, which produces separate supply passages (31, 31') from outlet openings (21, 21') of the vessel to the mixer structure (4) and which permits a flowing of the components only through these supply passages;

and furthermore a coupling-on means (15) for the releasable securing of the housing to the vessel.

The transition piece (3) of this apparatus has a symmetry axis, with respect to which it can be inserted into the transition part (11) rotatably or in a plurality of discrete rotational positions, and indeed in such a manner that it can be arranged as desired in one of the possible rotational positions with respect to the housing (1), the mixer structure (4) and the coupling-on means (15) during the assembly. The symmetry axis points in the direction of the tubular part (10).

14 Claims, 3 Drawing Sheets

Fig.1
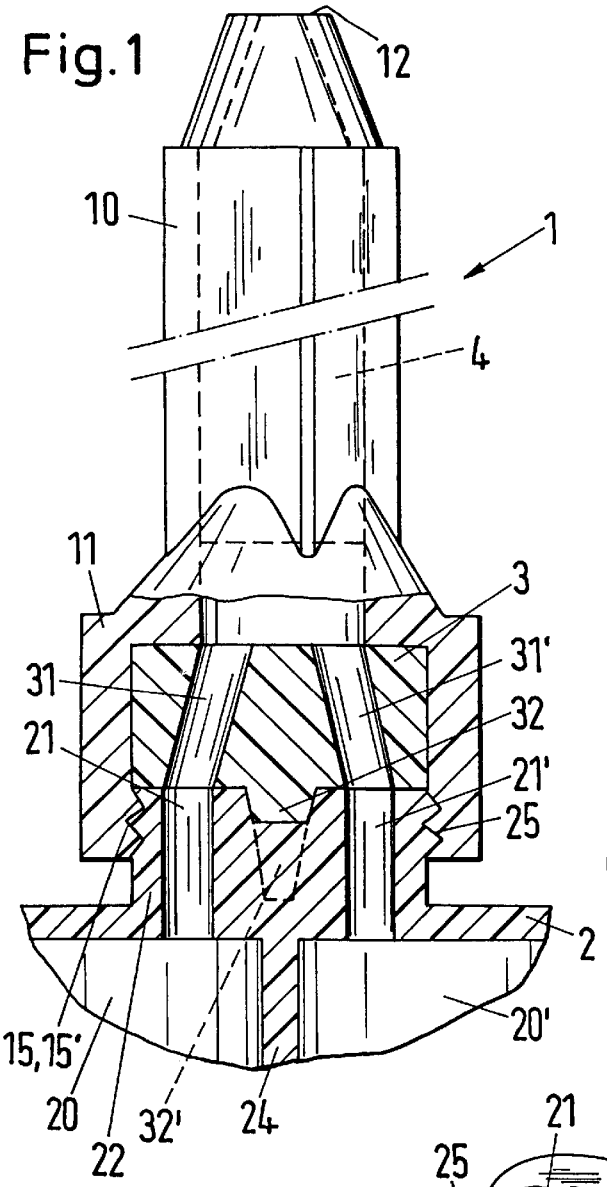
Fig.2
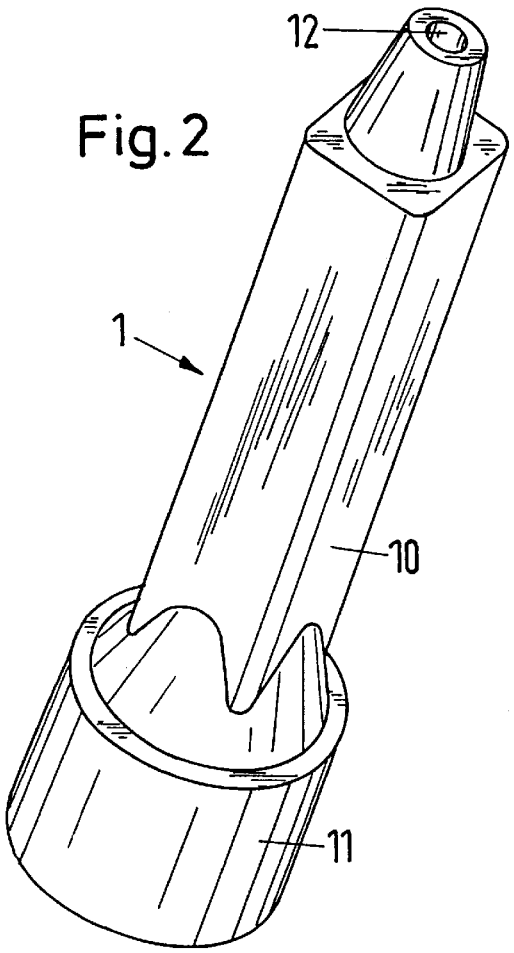
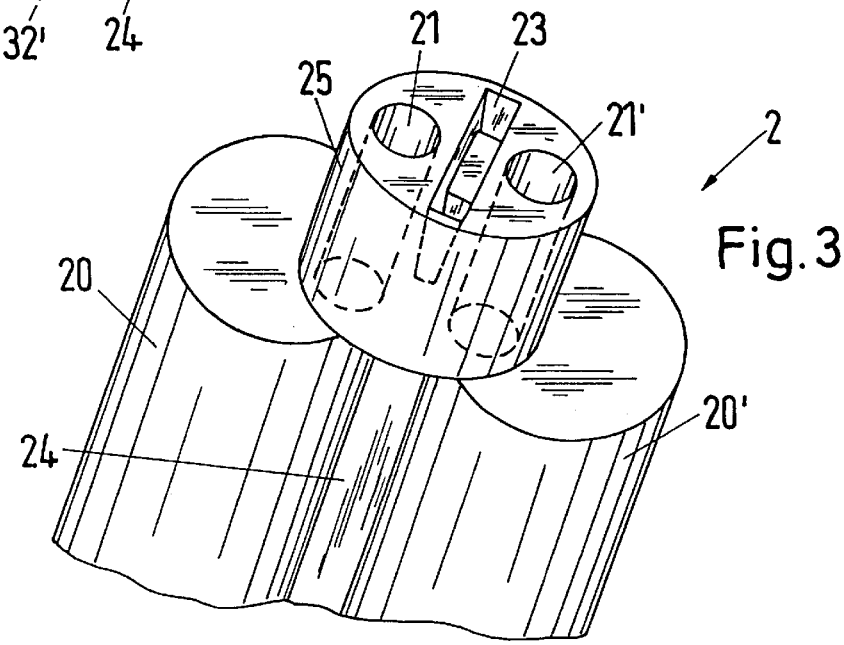
Fig.3

APPARATUS FOR CARRYING OUT A MIXING DISPENSING OF A PLURALITY OF FLOWABLE COMPONENTS

The invention relates to an apparatus for carrying out a mixing dispensing of a plurality of flowable components from a multiple chambered vessel and to uses of the apparatus. The multiple chambered vessel can also be a plurality of vessels or containers which are combined to a unit.

BACKGROUND OF THE INVENTION

Apparatuses with static mixers are known from U.S. Pat. No. 5,413,253 and EP-A 0 723 807 with which flowable components can be given off as mixtures from in each case one supply vessel, namely a cartridge with two chambers. Two-component mixtures of this kind are used for sealing and/or adhesive bonding purposes. As a result of reactions between the components the mixture solidifies. As a rule one wishes to be able to take mixtures out of a given supply of components at different time points lying apart from one another. After a taking out of this kind the reactive component mixture solidifies in the static mixer since it hardens with time. For carrying out a later dispensing the mixing apparatus must be replaced. Therefore apparatuses of this kind are provided as throw away articles which should cost as little as possible.

SUMMARY OF THE INVENTION

Using a suitably designed transition piece which is arranged between the outlet openings of the cartridge and the static mixer and which contains supply passages, it is prevented that a reaction can begin in the region of the outlet openings. The components which are contained in the supply passages act as barriers which prevent a contamination of the components in the cartridge as a result of a mixing of the components. During the replacement of a used mixer apparatus the transition piece is taken out together with the apparatus so that pure, reactive material can again be removed from the cartridge.

The object of the invention is thus to provide a mixer apparatus which is distinguished with respect to the previously known apparatuses by lower manufacturing costs. This object is satisfied by the apparatus.

The apparatus for carrying out a mixing dispensing of a plurality of flowable components from a multiple chambered vessel comprises the following parts: A housing which can be placed onto the vessel, having an outlet opening, a transition part which can be coupled to the vessel and a tubular part between the transition part and the outlet opening; a static mixer which consists of a structure which can be pushed into the tubular part; a transition piece which is arranged in the transition part and which produces separate supply passages from outlet openings of the vessel to the mixer structure and which permits a flowing of the components only through these supply passages; and furthermore a coupling-on means for the releasable securing of the housing to the vessel. The transition piece of this apparatus has a symmetry axis, with respect to which it can be inserted into the transition part rotatably or in a plurality of discrete rotational positions, and indeed in such a manner that it can be arranged as desired in one of the possible rotational positions with respect to the housing, the mixer structure and the coupling-on means during the assembly. The symmetry axis points in the direction of the tubular part.

The apparatus in accordance with the invention as well as the known apparatuses are put together from components which can be manufactured relatively economically of plastic by means of an injection moulding process. It should be possible to carry out the assembly of the components, which is advantageously carried with the help of automats, with as few steps as possible in order to be able to keep the manufacturing costs low. In contrast to the known apparatuses, assembly steps are omitted in the apparatus in accordance with the invention which are connected with a rotational position of the transition piece with respect to the housing or the coupling-on means respectively.

In the apparatus in accordance with U.S. Pat. No. 5,413,253 the coupling-on means comprises a bayonet lock. For the transition piece a predetermined orientation is to be observed with respect to this lock. In the apparatus in accordance with EP-A 0 723 807 a predetermined orientation is required with respect to the mixer structure chosen. In the assembly of the apparatus in accordance with the invention the transition piece can be inserted into the transition part in any desired rotational position with respect to the housing and with respect to the coupling-on means. Thus special measures and process steps with respect to the orientation of the transition piece such as are required in the known apparatuses are omitted. Thanks to this simplification the manufacturing costs are reduced.

BRIEF DESCRIPTION OF THE DRAWINGS

The invention will be described in the following with reference to the drawings. Shown are:

FIG. 1 is a first embodiment of the mixer apparatus in accordance with the invention which is placed on a two-chamber supply vessel, FIG. 2 is an oblique view of the apparatus of FIG. 1, FIG. 3 is a corresponding oblique view for the supply vessel without the mixer apparatus and FIGS. 4–7 are in each case the region of the transition piece of further embodiments of the apparatus in accordance with the invention.

DESCRIPTION OF THE PREFERRED EMBODIMENTS

Figure 4:
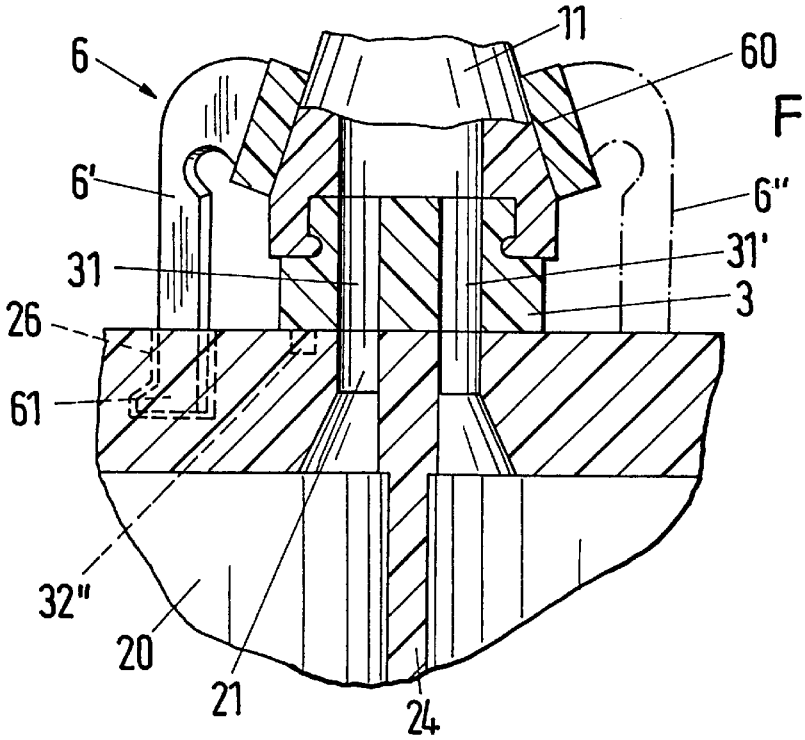

FIGS. 1 and 2 show an apparatus in accordance with the invention which comprises the following constituents: a housing 1 which can be placed onto a vessel 2 with an outlet opening 12 at its tip for mixed components, with the housing 1 having a transition part 11 which can be coupled onto the vessel 2 and a tubular part 10 between the transition part 11 and the outlet opening 12; a static mixer 4 having a structure which can be pushed into the tubular part 10; a transition piece 3 which is rotatably arranged in the transition part 11, which produces separate supply passages 31, 31' from outlet openings 21, 21' of the vessel 2 to the mixer structure 4 and which permits a flowing of the components only through these supply passages 31, 31'; and a coupling-on means 15, namely a screw thread 15', for the releasable securing of the housing 1 at the vessel 2. The vessel 2 which is shown in FIG. 3 and which is a cartridge in the present example, comprises two chambers 20, 20' (partition wall 24) for the storage of two components to be mixed and a connection part 22 with an inner screw thread 25 (not shown) which forms the counterpart to the outer screw thread 15' of the coupling-on means 15.

The transition piece 3 has a rotationally symmetrical outer contour. It can therefore be inserted into the transition part 11 during the assembly at any desired rotational position with respect to the housing 1, the mixer structure 4 and the coupling-on means 15.

The transition piece 3 has means 32 for its positioning on the vessel 2 with which a rotationally fixed position on the vessel 2 can be produced. These positioning means 32 consist in the illustrated example of parts which partially project out of the transition part, namely a rib with two prongs 32' at the edges. Corresponding depressions 23 which are formed to be complementary to the positioning means 32 of the transition piece 3 are arranged at the connection part 22 of the vessel 2. These depressions 23 can also be designed to be only partly complementary.

FIG. 4 shows the region of the transition piece 11 of a second embodiment in which the coupling-on means 15 comprises a part 6 which is attached separately to the transition part 11 and which can be secured to the vessel 2 by means of a releasable snap connection (6', 61, 26; 6"). The part 6 consists of a screw collar ring 60 and two spring-elastic legs 6' and 6" which can be hooked with feet 61 into corresponding depressions 26 of the vessel 2. The leg 6" indicated in chain-dotting lies in front of the plane of the drawing. The transition piece 3 consists of an elastomer material which—as illustrated in the drawing—is formed corresponding to an inner shape of the transition part 11 and is thus designed to be pressable into the latter. A positioning means 32" is indicated in broken lines.

In a two component cartridge the supply passages 31, 31' of the transition part are two cylindrical apertures, the axes of which lead in parallel or inclined (see FIG. 1 or FIG. 4 respectively) with respect to one another from the outlet openings 21 of the vessel 2 to the static mixer 4.

Figure 5:
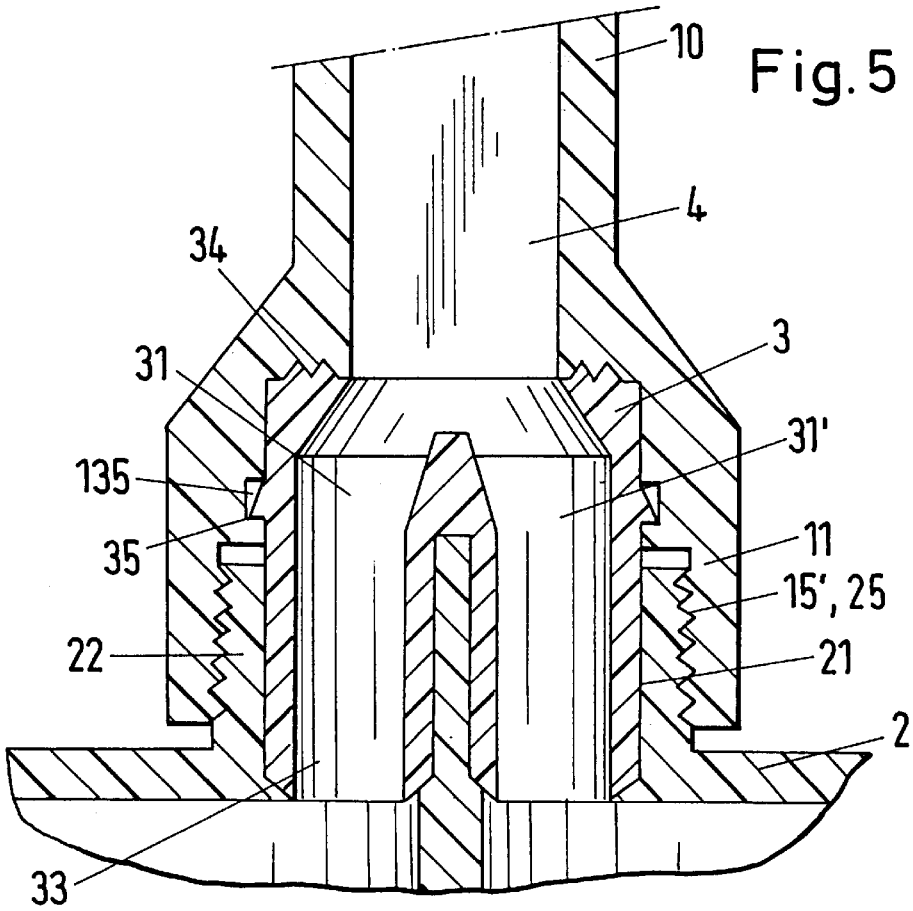

The region of the transition piece 11 of a third embodiment is illustrated in FIG. 5. Corresponding to the apparatus which is known from U.S. Pat. No. 5,413,253, two sleeve-shaped positioning means 33, which at the same time form the supply passages 31, serve for the securing of a rotationally fixed position. The thus constructed positioning means 33 have the advantage that a possibly contaminated portion of the contents is also removed from the outlet openings 21 of the vessel 2 when the apparatus 1 is replaced.

Additional sealing ribs 34 and 35 ahead of the mixer 4 prevent the components from escaping laterally into the surroundings. The sealing ring 35, which is arranged at the outer periphery of the transition piece 3, together with a ring groove 135, into which the sealing rib 35 is snapped, forms an anchoring in the transition part 11.

Figure 6:
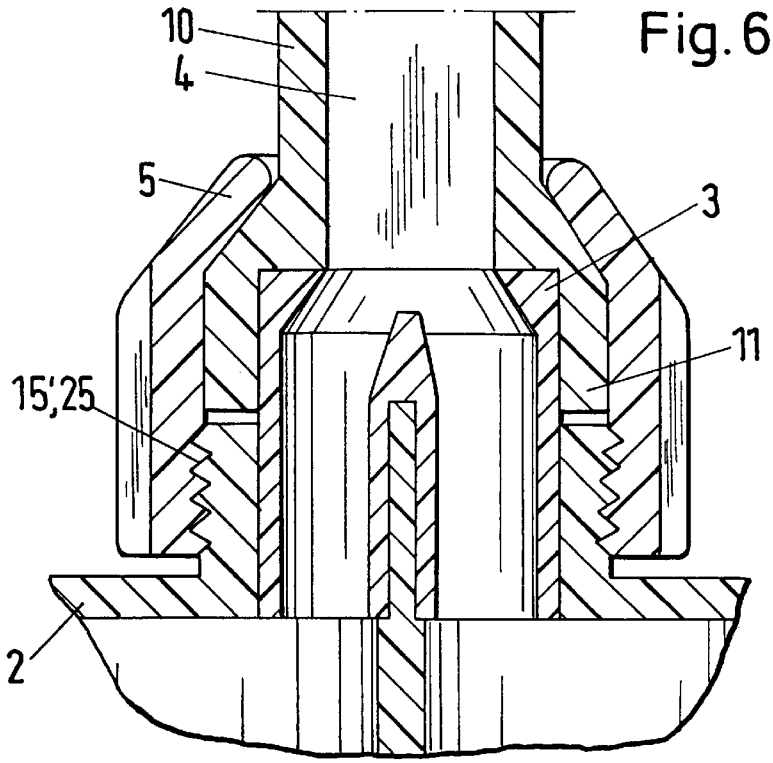

FIG. 6 shows the example in which, in contrast to that of FIG. 5, the transition part 11 can be secured on the vessel 2 by a clamping nut 5. In this exemplary embodiment -as well as that illustrated in FIG. 4 the transition piece 3 need not be designed to be rotatable. Its outer contour, which must be shaped so that it fits into the transition part 11, can have a cross-section, the outer sides of which form a regular polygon. If this polygon is for example a hexagon, then there are six discrete rotational positions in which the transition piece 3 can be fitted into the transition part 11. In order that a good sealing against the outside is present the transition piece 3 can also be adhesively bonded or welded into the transition part 11 or non-releasably connected to the latter in some other manner (through shrinking or pressing in into a snug fit). With a non-releasable fixing of this kind it is also prevented that the transition piece 3 can fall out of the transition part 11. No product can escape laterally between the transition piece 3 and the transition part 11 under the high pressures (up to 20 bar) which can arise during the metering in the mixer. The fixing of the transition piece 3 furthermore has the advantage that the transition piece 3 does not remain stuck to the cartridge when a used mixer is being replaced, so that the new mixer can be pushed onto the partly used cartridge without problem.

Figure 7:
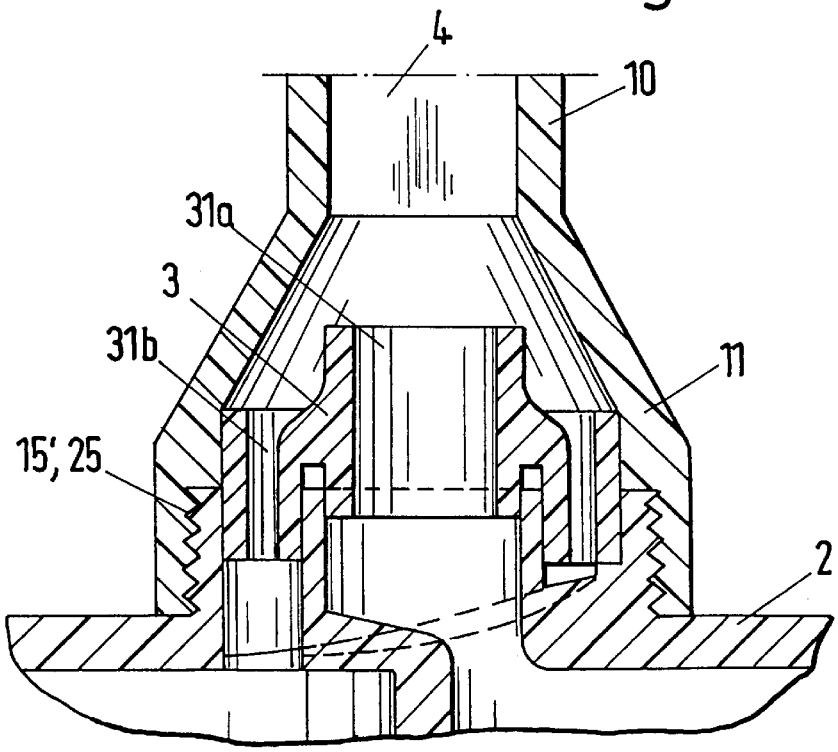

FIG. 7 shows a transition part 11 of an apparatus in accordance with the invention for a cartridge 2 with "central metering": The supply passages—and the corresponding holds for the outlet openings of the cartridge 2—are formed by a centrally arranged, cylindrical aperture 31*a* and a ring-gap-shaped aperture 31*b* which is arranged concentrically to it.

A structure is advantageously chosen for the mixer 4 which is described in EP-A 0 815 929 (=P.6741): This structure is formed of a bundle of four parallel strings comprising chambers in the shape of a rectangular parallelepiped; the chambers are connected to the chambers of adjacent strings via openings, the number of which amounts to four as a rule, with the chambers being separated from one another within a string by closed walls. A mixer structure of this kind yields good mixing results over a comparatively short distance. The inflow conditions, which depend on the rotational position of the transition piece 3 relative to the mixer structure 4, have no disturbing influence on the mixing quality.

The two or more chambered vessel 2 can also be part of a metering device in which the chambers of the vessel 2 are passage spaces for the amounts of components to be mixed which are to be metered and separately supplied.

What is claimed is:

1. Apparatus for carrying out a mixing dispensing of a plurality of discrete flowable components from a multiple chambered vessel having a discrete flowable component in each chamber of the multiple chambered vessel and an outlet from each chamber of the multiple chambered vessel;

a housing which can be placed onto the multiple chambered vessel, the housing having an outlet opening, a tubular part, and an inlet;

a static mixer disposed in the tubular part of the housing;

a transition piece for producing separate supply passages from each outlet of each chamber of the multiple chambered vessel to the inlet of the housing, the separate supply passages being symmetrically disposed about an axis through the transition piece;

a transition part for capturing the transition piece between the outlets from each chamber of the multiple chambered vessel and the inlet to the housing; and, a discrete rotational positioner attached to the transition piece and extending to the multiple chambered vessel for maintaining a plurality of rotational positions relative to the axis through the transition piece in any desired rotational position, at least some rotational positions aligning an outlet from each chamber of the multiple chambered vessel to a separate supply passage of the transition piece whereby when the housing is changed, the transition piece can likewise be changed and aligned to one of the rotational positions to permit mixing of the discrete flowable components from the multiple chambered vessel.

2. The apparatus for carrying out a mixing dispensing of a plurality of discrete flowable components from a multiple chambered vessel according to claim 1 and wherein:

the transition piece has a feature contacting the multiple chambered vessel for producing the plurality of rotational positions.

3. The apparatus for carrying out a mixing dispensing of a plurality of discrete flowable components from a multiple chambered vessel according to claim 2 and wherein:

the feature on the transition piece comprises a projection on the transition piece and the multiple chambered vessel defines a corresponding indentation.

4. The apparatus for carrying out a mixing dispensing of a plurality of discrete flowable components from a multiple chambered vessel according to claim 1 and wherein:

the transition part is provided with threads; and, the multiple chambered vessel is provided with counter threads for engagement with the threads on the transition part to maintain the transition part capturing the transition piece to the multiple chambered vessel.

5. The apparatus for carrying out a mixing dispensing of a plurality of discrete flowable components from a multiple chambered vessel according to claim 1 and further including:

a coupling which can be releasably secured to the multiple chambered vessel, the coupling arranged to capture the transition part and the transition piece to the multiple chambered vessel.

6. The apparatus for carrying out a mixing dispensing of a plurality of discrete flowable components from a multiple chambered vessel according to claim 1 and wherein:

the separate supply passages of the transition piece are cylindrical and aligned with respect to the axis through the transition piece.

7. The apparatus for carrying out a mixing dispensing of a plurality of discrete flowable components from a multiple chambered vessel according to claim 6 and wherein:

the passages are inclined with respect to one another.

8. The apparatus for carrying out a mixing dispensing of a plurality of discrete flowable components from a multiple chambered vessel according to claim 1 and wherein:

the supply passages of the transition piece are concentrically arranged cut-outs.

9. The apparatus for carrying out a mixing dispensing of a plurality of discrete flowable components from a multiple chambered vessel according to claim 8 and wherein:

the supply passages are in the shape of a ring gap.

10. The apparatus for carrying out a mixing dispensing of a plurality of discrete flowable components from a multiple chambered vessel according to claim 1 and wherein:

the transition piece includes sealing elements to prevent the lateral escape of the discrete components from the multiple chambered vessel.

11. The apparatus for carrying out a mixing dispensing of a plurality of discrete flowable components from a multiple chambered vessel according to claim 1 and wherein:

the static mixer is formed of a bundle of four parallel strings comprising chambers in the shape of a rectangular parallel pipes; and, the chambers are connected via four openings to chambers of adjacent strings.

12. A process for carrying out a mixing dispensing of a plurality of discrete flowable components from a multiple chambered vessel having a discrete flowable component in each chamber of the multiple chambered vessel and an outlet from each chamber of the multiple chambered vessel, the process comprising the steps of;

providing a housing which can be placed onto the multiple chambered vessel, the housing having an outlet opening, a tubular part, and an inlet;

providing a static mixer disposed in the tubular part of the housing;

providing a transition piece for producing separate supply passages from each outlet of each chamber of the multiple chambered vessel to the inlet of the housing, the separate supply passages being symmetrically disposed about an axis through the transition piece;

providing a transition part for capturing the transition piece between the outlets from each chamber of the multiple chambered vessel and the inlet to the housing;

providing a discrete rotational positioner attached to the transition piece and extending to the multiple chambered vessel for maintaining a plurality of rotational positions relative to the axis through the transition piece, each rotational position aligning an outlet from each chamber of the multiple chambered vessel to a separate supply passage of the transition piece whereby when the housing is changed, the transition piece can likewise be changed and aligned to one of the rotational positions to permit mixing of the discrete flowable components from the multiple chambered vessel;

mixing and dispensing the discrete flowable components in the housing; and, replacing at least the transition piece after the mixing and dispensing step.

13. A process for carrying out a mixing dispensing of a plurality of discrete flowable components from a multiple chambered vessel according to claim 12 and wherein the replacing step includes:

replacing the housing after the mixing and dispensing step.

14. A process for carrying out a mixing dispensing of a plurality of discrete flowable components from a multiple chambered vessel according to claim 12 and including the additional step of:

providing a multiple chambered vessel which is a metering device.

* * * * *